US005850713A

United States Patent [19]

Hojo

[11] Patent Number: 5,850,713

[45] Date of Patent: Dec. 22, 1998

[54] DEVICE RAISING AND LOWERING APPARATUS

[75] Inventor: Yukinori Hojo, Kurashiki, Japan

[73] Assignee: Yuasa Koki Co., Ltd, Okayama, Japan

[21] Appl. No.: 772,144

[22] Filed: Dec. 20, 1996

[51] Int. Cl.[6] ..... E04H 12/34; B06F 11/04

[52] U.S. Cl. ..... 52/115; 52/118; 212/296; 92/52

[58] Field of Search ..... 52/115, 117, 118, 52/184, 218; 92/51, 52, 53; 212/296, 297, 347, 348, 349, 350; 254/93 H, 93 R

[56] References Cited

U.S. PATENT DOCUMENTS

| | | | |
|---|---|---|---|
| 191,516 | 6/1877 | Comings | 92/52 X |
| 1,482,256 | 1/1924 | Prall . | |
| 2,646,504 | 7/1953 | Gosline | 92/52 |
| 2,689,025 | 9/1954 | Yates | 52/115 |
| 3,358,952 | 12/1967 | Burns . | |
| 3,688,455 | 9/1972 | Zebuhr | 52/115 |
| 3,958,376 | 5/1976 | Campbell | 52/115 |
| 4,386,487 | 6/1983 | Scott | 52/184 |
| 4,513,938 | 4/1985 | Seymour | 52/118 X |
| 5,333,422 | 8/1994 | Warren et al. | 52/118 X |

FOREIGN PATENT DOCUMENTS

| | | |
|---|---|---|
| 535 681 | 12/1958 | Belgium . |
| 0 296 047 | 12/1988 | European Pat. Off. . |
| 2 345 608 | 10/1977 | France . |
| 1 107 383 | 5/1961 | Germany . |
| 1 141 428 | 12/1962 | Germany . |
| H3-117103 | 12/1991 | Japan . |
| 180 486 | 6/1936 | Switzerland . |
| 760067 | 10/1956 | United Kingdom . |

*Primary Examiner*—Christopher Kent
*Assistant Examiner*—Timothy B. Kang
*Attorney, Agent, or Firm*—Koda & Androlia

[57] ABSTRACT

An apparatus for raising and lowering devices such as an antenna including a multiple-stage cylinder system composed of a plurality of telescopically connected cylinder units each of which comprising an internal cylinder and an external cylinder that are connected at their lower ends so that the internal cylinders of the plurality of cylinder units form a sealed space so as to be filled with pressure oil used for extending and contracting the cylinder system. In addition, a fixture structure is provided on the lowest stage cylinder unit so that the cylinder system is held upright by the fixture structure at two points on the lowest stage cylinder unit in a vertical direction.

4 Claims, 8 Drawing Sheets

| | | |
|---|---|---|
| Maximum Load | 50 Kg | 50 Kg |
| Maximum Length | 10.0 m | 12.0 m |
| Minimum Length | 1.7 m | 2.0 m |
| Extension Ratio | 5.88 | 6.00 |
| Stage Number | Seven Stages | Seven Stages |
| Diameter of Internal Cylinder | 65 mm | 65 mm |
| Diameter of External Cylinder | 150 mm | 150 mm |

DEVICE RAISING AND LOWERING APPARATUS

BACKGROUND OF THE INVENTION

1. Filed of the Invention

The present invention relates to an apparatus for raising and lowering relatively light-weight devices from the ground.

2. Prior Art

Among various devices, such as, antennas, cameras, lighting equipment, loudspeakers, measuring devices and the like, some are raised above the ground only when used and lowered for storage when not used. Thus, the raising and lowering function is very important for these devices, particularly for those that are loaded and transported on a car or a ship since transportation is difficult when they are raised.

Usually, such devices are mounted on the top of, for example, an extendable pole. The pole adapted for such purposes requires a large extension ratio (an extended length /a contracted length); and a conventionally known device of this type is a multi-stage oil pressure cylinder pole which includes a plurality of slidably engaged cylinders connected in a telescopic fashion. However, the typical conventional telescopic cylinder pole needs to have an assembly of special cylinders and complicated oil passages in order to accomplish successive cylinder movements. As a result, a large over-wrapping length is required for the connecting points of the telescopic cylinders when they are extended, while the stage number (or the number of used telescopic cylinders) tend to be limited. This causes the extension ratio to be small. Furthermore, in order for a pole that has a relatively large extension ratio to be stable, a special fixing structure is required.

SUMMARY OF THE INVENTION

The object of the present invention is to solve the problems of the prior art telescopic cylinder type pole apparatus.

The primary object of the present invention is to provide a device raising and lowering apparatus that comprises a multi-stage oil pressure cylinder structure that has a large extension ratio and a fixture means adapted so that the cylinder structure can stand upright stably.

The object of the present invention is accomplished by a unique structure for a raising and lowering apparatus that includes a multiple-stage oil pressure cylinder structure and a fixture means that holds the cylinder structure. The multiple-stage oil pressure cylinder structure is formed from a plurality of cylinder units, and each cylinder unit comprises an internal cylinder and an external cylinder that are connected at their lower ends to an end member. An upper internal cylinder slidably engages with an exterior surface of an adjacent lower internal cylinder, and an upper external cylinder slidably engages with an interior surface of an adjacent lower external cylinder so that the cylinder units are connected together in an up-to-down relationship. An upper end of the uppermost internal cylinder is covered by a support table, and a lower end of the lowest internal cylinder is covered by a base, wherein the internal cylinders form a sealed space filled with pressure oil and communicate with one another. The pressure oil is fed into and discharged from the sealed space through the lowest internal cylinder so as to extend and contract the cylinder structure, thus raising and lowering a device placed on the support table. The fixture means comprises the base and a holding member, the base being provided with a fixing structure and the holding member being mounted on the external surface of the lowest external cylinder so that the multi-stage oil pressure cylinder structure securely stands upright due to the fixture means.

With structure described above, each of the cylinder units defines a dual structure formed from the internal and external cylinders and thus has a greater structural rigidity. Accordingly, only a smaller over-wrapping length between the cylinder units is required when the cylinder structure is extended by the pressure oil. Furthermore, since the pressure oil is fed in and discharged through the communicated space formed inside the internal cylinders, the formation of pressure oil passages is very simple. Accordingly, many stages (or many cylinder units) can be used with a greater extension ratio.

In addition, the higher the stages of the internal cylinders, the greater the pressure receiving area within the interiors of the internal cylinders that is filled with pressure oil. Therefore, when the multi-stage cylinder structure is extended, the uppermost interior cylinder is first pushed up by the pressure oil. When the uppermost interior cylinder is completely pushed up, the second internal cylinder starts to be pushed up by the pressure oil. Thereafter, the lower stage cylinders are successively pushed up until the lowest interior cylinder is completely pushed up by the pressure oil. On the other hand, when the multi-stage cylinder structure is contracted by discharging the pressure oil, the relationship of the pressure receiving surface causes the lowest interior cylinder to first be lowered, the second lowest interior cylinder follows, and then the next upper stage cylinders are successively lowered. These successive extending and contracting movements of the cylinder structure comprising a plurality of cylinder units are executed smoothly.

In addition, since the multiple stage oil pressure cylinder structure, which has a large extension ratio, is fixed at two points in a vertical direction by the fixture means comprising the base and the holding member, the raising and lowering apparatus is stably held in an upright position.

DETAILED DESCRIPTION OF THE PREFERRED EMBODIMENTS

Figure 1:
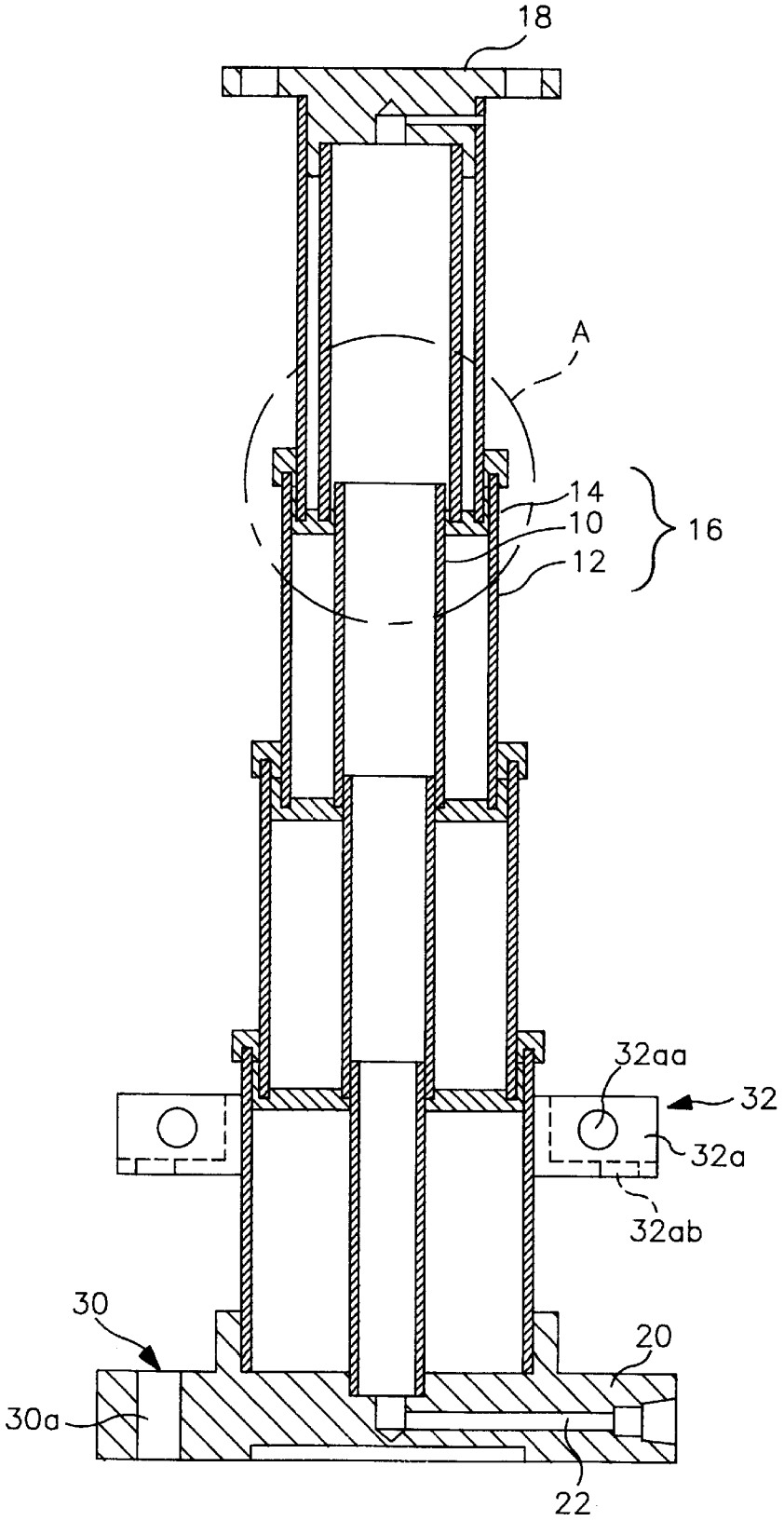
FIG. 1 shows a cross-sectional view of an extended multiple-stage oil pressure cylinder type raising and lowering apparatus in accordance with an embodiment of the present invention.
Figure 2:
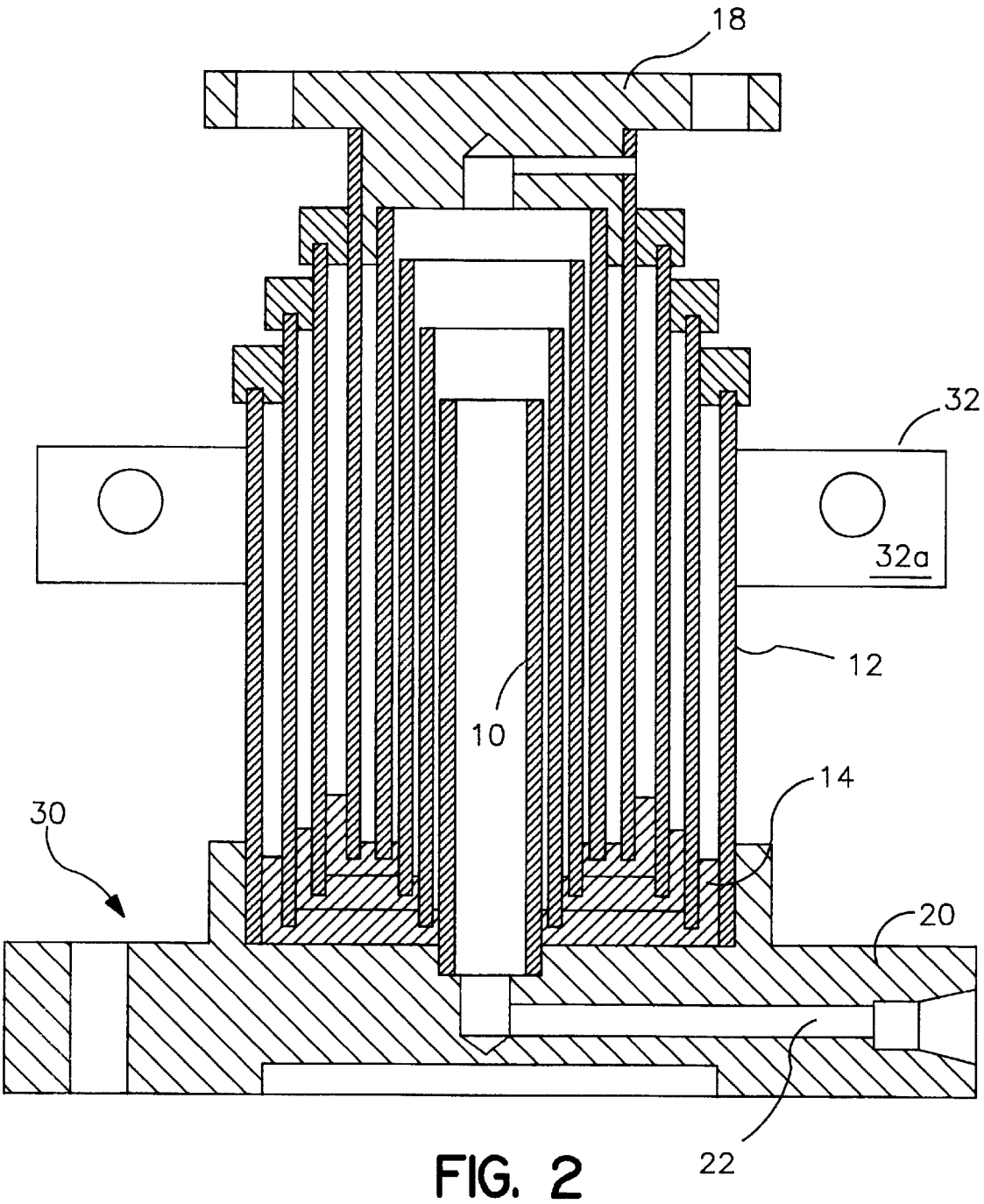
FIG. 2 shows a cross-sectional view of the same in a contracted state.

Embodiments of the present invention will be described hereunder with reference to the accompanying drawings. FIG. 1 shows the device raising and lowering apparatus of the present invention in its extended state that comprises a multiple oil pressure cylinder structure and a fixture means, and FIG. 2 shows the raising and lowering apparatus in its contracted state.

The multiple-stage oil pressure cylinder structure has a telescopic structure that is extended and contracted, and the fixture means securely stands the cylinder structure in an upright position.

The multiple-stage oil pressure cylinder structure includes a plurality of cylinder units 16. Each of the cylinder units 16 comprises an internal cylinder 10 and an external cylinder 12 that are connected at their respective lower ends to an end member 14. An upper one of the internal cylinders 10 slidably engages an external surface of an adjacent lower one of the internal cylinders 10, and an upper external cylinder 12 slidably engages an internal surface of an adjacent lower one of the external cylinder 12 so that the cylinder units 16 are connected telescopically in a top-to-down direction. By this arrangement, the upper the stages of the internal cylinders 10, the larger the diameter of the internal cylinders 10; and the lower the stages of the external cylinders 12, the larger the diameter of the external cylinders 12.

In addition, a support table 18 is attached to the upper ends of the uppermost internal cylinder 10 and external cylinder 12. Thus, the upper end of the uppermost internal cylinder 10 is covered by the support table 18. Also, a base 20 is attached to lower ends of the lowest internal cylinder 10 and external cylinder 12. In other words, the base 20 serves as an end member attached to the lowest internal cylinder 19 and external cylinder 12. Thus, the lower end of the lowest internal cylinder 10 is covered by the base 20.

By the telescopic arrangement described above, the interior spaces of the internal cylinders 10 communicate with one another so as to define a sealed chamber space. An oil passage 22 that communicates with the interior of the internal cylinders 10 (or the sealed chamber space) is formed in the base 20, and pressure oil is fed into the oil passage 22. As a result, the communicating interior space of the internal cylinders 10 is filled with the pressure oil. Thus, by charging or discharging the pressure oil, the cylinder structure comprising telescopically connected cylinder units 16 can extend or contract.

Figure 3:
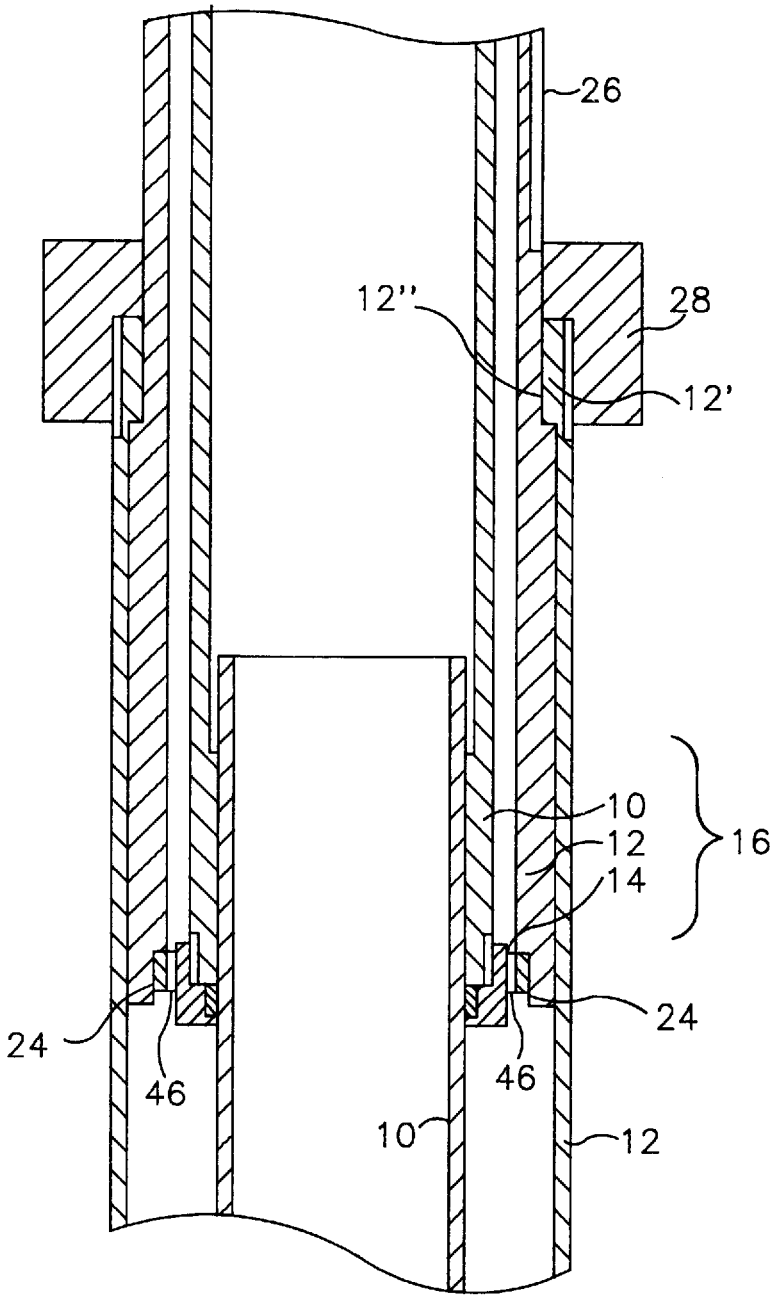
FIG. 3 shows an enlarged cross-sectional view of an area A in FIG. 1.

FIG. 3 shows an enlarged cross-sectional view of the area A shown in FIG. 1.

As seen from FIG. 3, the lower ends of the internal cylinder 10 and the external cylinder 12 of each cylinder unit are connected by the end member 14, using screws and snap rings 24. A key groove 26 extending in the vertical direction is formed in the external surface of the external cylinder 12, and a dust seal 28 defining a key that engages the key groove 26 is fixed to the upper end of the external cylinder 12 by screws. Accordingly, the external cylinders 12 are mutually prevented from rotating with respect to each other about the axes. Furthermore, thicker stepped sections 12' and 12" are provided adjacent upper and lower end portions of each of two adjacent external cylinders 12 so that the stepped sections 12' and 12" function as stoppers when the cylinder unit is extended.

An operation of the multiple-stage oil pressure cylinder structure will be described below.

When the pressure oil is discharged from the interior space of the internal cylinders 10, the cylinder structure is in the contracted state as shown in FIG. 2. In this state, an upper one of the end members 14 abuts an adjacent lower one of the end members 14 so that the cylinder units 16 cannot be contracted further.

When pressure oil is fed into the oil passage 22, only the uppermost internal cylinder 10 is first pushed up by the pressure oil because the uppermost internal cylinder 10 has the largest pressure receiving area. When the uppermost internal cylinder 10 is pushed up a specified length, the stepped portions 12' and 12" on the sliding surfaces abut against each other and thus prevent further upward movement of the uppermost (or innermost) cylinder unit. Then, the second uppermost internal cylinder 10 is pushed up by the pressure oil, and in a like manner, the remaining internal cylinders are successively pushed up, thus extending the cylinder structure. When the lowest internal cylinder 10 is completely pushed up for its length (or height), the cylinder structure reaches its maximum extended length, as shown in FIG. 1.

On the other hand, when the pressure oil is discharged through the oil passage 22, the lowest internal cylinder 10 first is lowered because it has the smallest pressure receiving area. When the lowest internal cylinder 10 is completely lowered, the second lowest internal cylinder starts being lowered; and the following lower stage internal cylinders successively are lowered, thus contracting the cylinder structure.

It is noted that the internal cylinders 10 moving in the manner described above are connected telescopically to the external cylinders 12 by the respective end members 14. Accordingly, a person would see only the external cylinders moving when the internal cylinders 10 are actually moving up and down.

The above-described cylinder structure is held upright by a fixture structure that is fixed to a fixed member.

Figure 4:
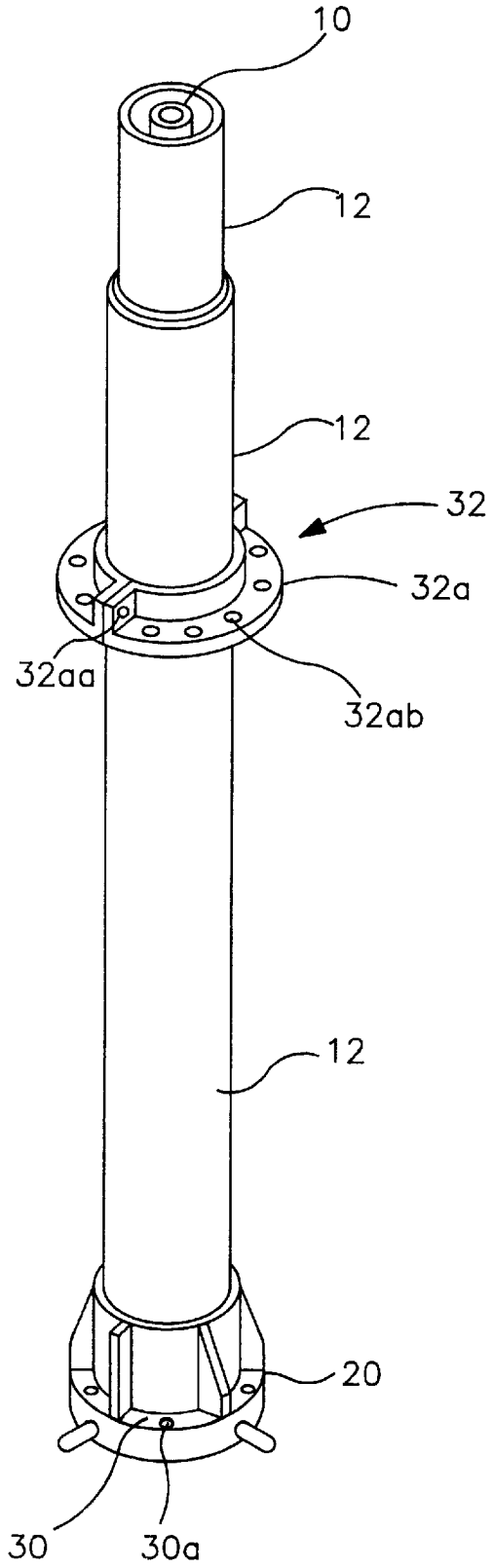
FIG. 4 shows a perspective view of the multiple-stage oil pressure cylinder type raising and lowering apparatus.

FIG. 4 is perspective view of a multiple-stage oil pressure cylinder structure provided with the fixture structure. The fixture structure comprises a mounting structure 30 formed on the base 20 and a holding member 32 that is fixed on the external surface of the lowest external cylinder 12.

The mounting structure 30 can be formed in various ways. The most common way is to provide vertical through holes 30*a* in the base 20 so that fixing bolts pass through the base 20 via these through holes 30*a*. In other words, the base 20 is larger than that the external cylinder 12 in diameter (when the base 20 is circular), and the through holes 30*a* are drilled in the base 20 at several locations in the circumferential direction around the exterior cylinder 12.

The holding member 32 also can be formed in various ways. In this embodiment, a ring member 32*a* is used; and this ring member 32*a* is mounted on the external surface of the lowest external cylinder 12. The ring member 32*a* can be a split into two sections for assuring an easy mount onto the external cylinder 12. The two sections have abutting surfaces that have through holes 32*aa* drilled therein. The sections are tightened together by bolts passed through the through holes 32*aa*. Vertical through holes 32*ab* for bolts are also drilled in ring sections of the ring member 32*a*. The advantage of this structure is that the vertical position of the ring member 32*a* can be readily adjusted.

Figure 5:
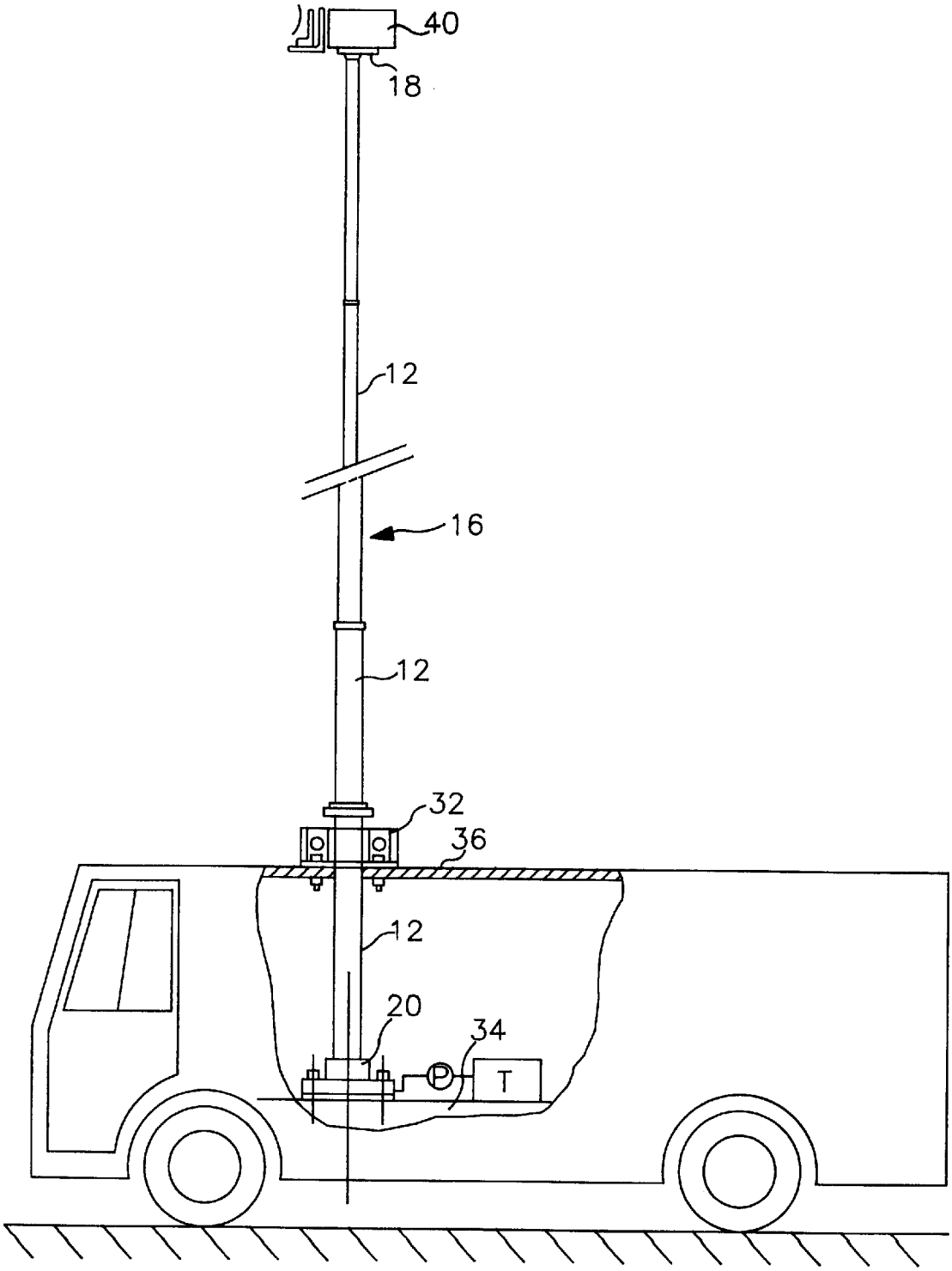
FIG. 5 shows a partial cross-section of an antenna car equipped with the raising and lowering apparatus of the present invention.

FIG. 5 shows a side view of an antenna car provided with the above-described device raising and lowering apparatus in accordance with the embodiment of the present invention.

The base 20 is mounted on a vehicle base 34, and the cylinder structure extends upwardly through a hole that is opened in the roof 36 of the car. The cylinder structure is fixed to the vehicle base 34 by fixing bolts that passe through the through holes 30*a* of the base 20 (see FIG. 4), and the holding member 32 is positioned to engage the roof 36 and be fixed thereto by fixing bolts that passe through the through holes 32*ab* (see FIG. 4). An antenna 40 is installed on the support table 18.

Figure 6:
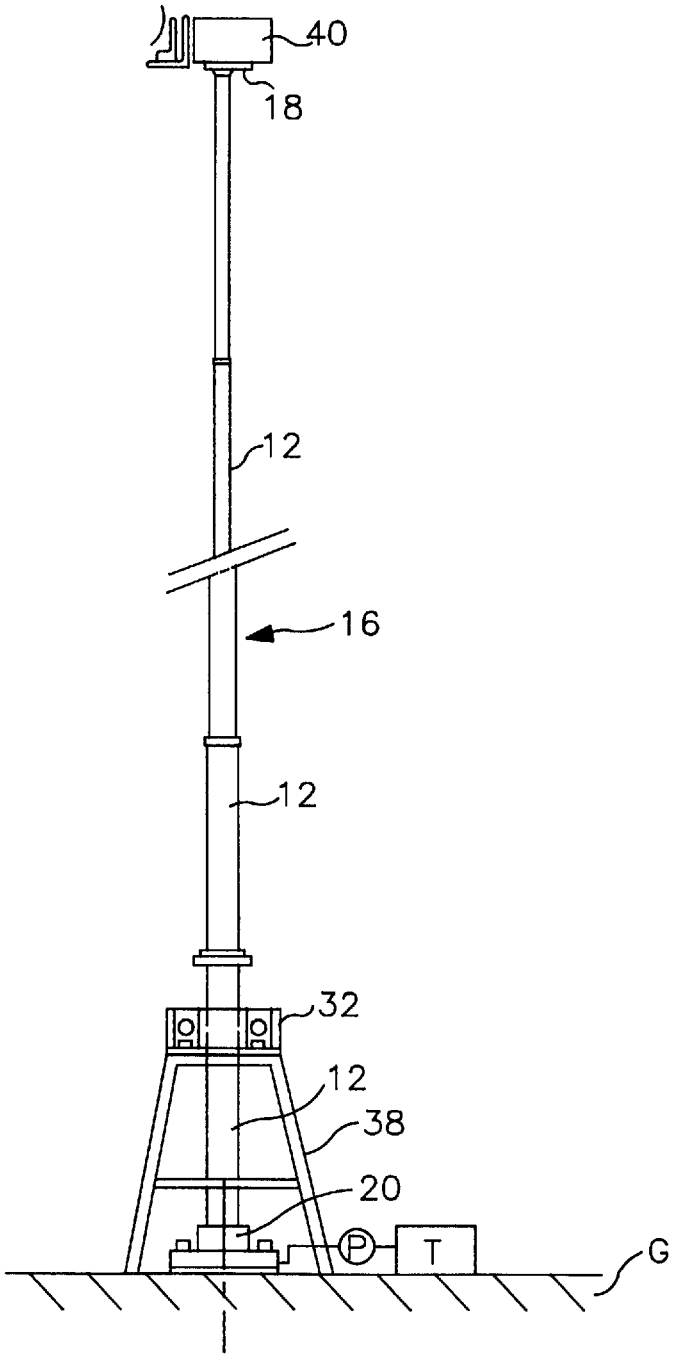
FIG. 6 shows the raising and lowering apparatus of the present invention installed on the ground using a fixture means.

FIG. 6 shows a side view of the device raising and lowering apparatus that stands on the ground in accordance with the embodiment of the present invention.

The base 20 is fixed to the ground G. An appropriate support structure 38 is provided on the ground G, and the holding member 32 is fixed to the upper end of the support structure 38.

In both of the above cases shown in FIGS. 5 and 6, the multiple-stage oil pressure cylinder structure is fixed at two positions, namely, the upper and lower positions via the holding member 32 and the base 20. Accordingly, the multiple-stage oil pressure cylinder structure can be stably maintained.

In the embodiments described above, the holding member 32 is attached to the lowest external cylinder 12 because the lowest external cylinder 12 is not pushed up by the pressure oil, and therefore, the position of the holding member 32 can be fixed while not being affected by the extension and contraction of the cylinder structure.

The antenna 40 is installed on the support table 18 which is provided on the uppermost cylinder unit. The cylinder structure is contracted to lower the antenna 40 during transportation and extended to raise the antenna 40 when the antenna 40 is used.

Figure 8:
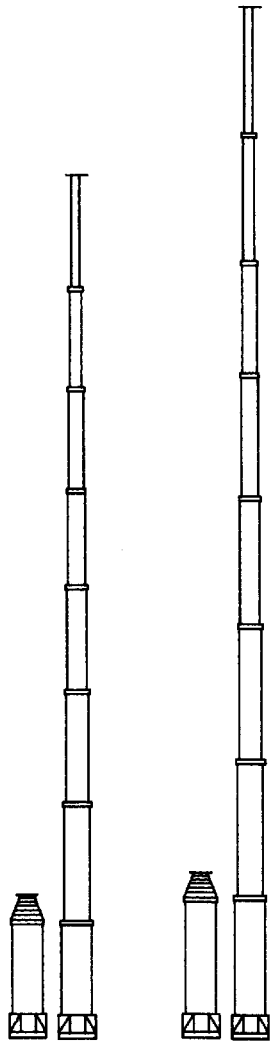
FIG. 8 is a table showing an extension ratio and other data of the raising and lowering apparatus.

In a device raising and lowering apparatus that is formed from a multiple-stage cylinder structure comprising a plurality of cylinder units, an internal cylinder and an external cylinder of each unit are formed in a dual structure. This structural feature provides a greater structural rigidity in the apparatus and thus only a smaller cylinder over-wrapping length is required when the cylinder structure is extended. Furthermore, such a structural feature allows the pressure oil chambers and oil passages to be formed easily in the apparatus, and this results in that the cylinder structure can include many stages of cylinder units. As a consequence, the cylinder structure may have a substantially large extension ratio when the device to be raised is relatively lightweight. FIG. 8 shows an apparatus in accordance with an embodiment of the present invention that includes seven stages of cylinder units. Thus, it is possible to provide a cylinder structure that has an extension ratio of six (6) (that is, the extended cylinder structure is six times longer when it is fully extended).

Figure 7:
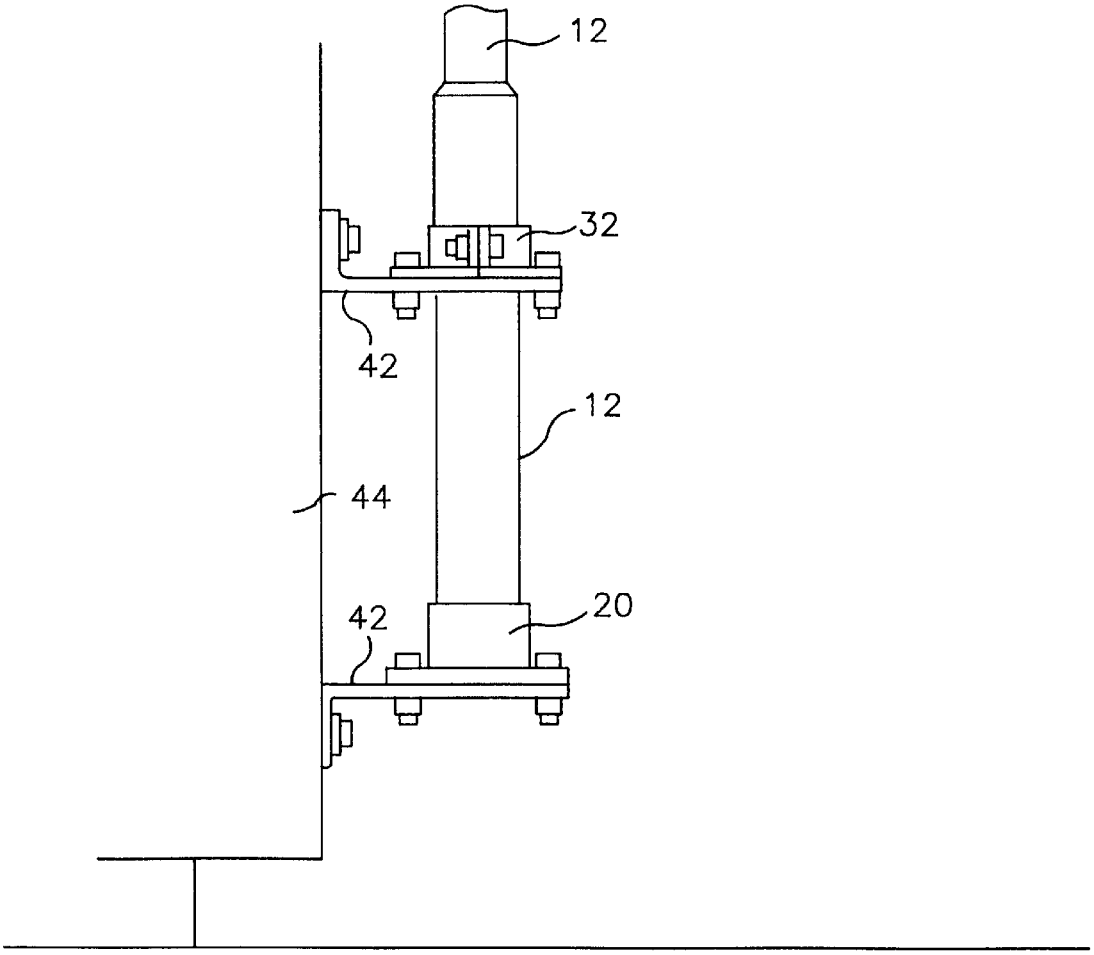
FIG. 7 shows a side view of a main portion of a fixture means in accordance with another embodiment of the present invention.

FIG. 7 is a side view of the fixture structure in accordance with another embodiment of the present invention. In this embodiment, both the base 20 and the holding member 32 are fixed to a fixed structure 44 by means of adapters 42. The adapter 42 can be in any shape so that it matches the fixed member 44 in a variety of different shapes.

In addition, the end member 14 can be provided with small through holes 46 extending parallel to the axis of the cylinder unit 16 as shown in FIG. 3 so that an annular space formed between the interior cylinder 10 and the exterior cylinder 12 of one cylinder unit 16 communicates via the through holes 46 with an annular space formed between the interior cylinder 10 and the exterior cylinder 12 of the lower cylinder unit 10. Heated air, for instance, is introduced into the annular spaces from the lowest cylinder unit so that it can go out from the outermost cylinder unit. Since the heated air can reduce the friction resistance between the engaged interior cylinders 10 and the engaged exterior cylinders 12, the apparatus can be used easily under cold weather. In addition, by increasing the air pressure inside the annular spaces of the cylinder units 16, it is possible to prevent rain from coming into the annular spaces.

As seen from the above, according to present invention, a device raising and lowering apparatus is obtained from multiple-stage cylinder units that have a substantially large extension ratio, and the apparatus is stably and firmly maintained in an upright position by a fixture means that has a relatively simple structure.

I claim:

1. A device raising and lowering apparatus comprising:

a multiple-stage oil pressure cylinder means including a plurality of cylinder units, each of said cylinder units including an internal cylinder and an external cylinder coupled at lower ends thereof via an end member, an upper one of said internal cylinders slidably engaging an exterior surface of a lower one of said internal cylinders and an upper one of said external cylinders slidably engaging an interior surface of a lower one of said external cylinders so that said cylinder units are connected together in an up-to-down relationship, a key groove being formed in an external surface of each of said upper external cylinders and extending in a vertical direction so that which is screwed to a lower external cylinder and functions as a dust seal is inserted into said key groove to prevent said external cylinders from rotating, an upper end of an uppermost one of said internal cylinders being covered by a support table, a lower end of a lowest one of said internal cylinders being covered by a base so that said internal cylinders form therein a sealed space communicating with one another and filled with pressure oil which is fed or discharged through a lowest internal cylinder so as to extend or contract said pressure cylinder means to raise or lower a device placed on said support table, and said end member of each of said cylinder units being provided with a hole so that a space between said inner and outer cylinders of each of said cylinder units communicates with a space of other cylinder units so that heated air circulates in said space; and a fixture structure including a mounting structure provided in said base and a holding member attached to said lowest external cylinder, wherein said base and holding member are attached to a fixed member so that said multi-stage oil pressure cylinder means is fixedly held upright.

2. A device raising and lowering apparatus according to claim 1, wherein said holding member is a ring member so that said holding member can be moved in a vertical direction on said external cylinder and tightened to fix to said external cylinder.

3. A device raising and lowering apparatus according to claim 1 or 2, wherein said base and holding member are directly fixed to said fixed member.

4. A device raising and lowering apparatus according to claim 1 or 2, wherein said base and holding member are fixed to said fixed member by means of adapters.

* * * * *